US007069906B2

(12) United States Patent
Josten et al.

(10) Patent No.: US 7,069,906 B2
(45) Date of Patent: Jul. 4, 2006

(54) THROTTLE HOUSING COMPRISING A MODULAR LID ELEMENT

(75) Inventors: Stefan Josten, Stuttgart (DE); Markus Michels, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 82 days.

(21) Appl. No.: 10/488,990

(22) PCT Filed: Nov. 26, 2002

(86) PCT No.: PCT/DE02/04330

§ 371 (c)(1),
(2), (4) Date: Mar. 10, 2004

(87) PCT Pub. No.: WO03/067058

PCT Pub. Date: Aug. 14, 2003

(65) Prior Publication Data

US 2004/0231643 A1 Nov. 25, 2004

(30) Foreign Application Priority Data

Feb. 7, 2002 (DE) ..... 102 05 090

(51) Int. Cl.
*F02D 9/10* (2006.01)
*F02D 11/10* (2006.01)

(52) U.S. Cl. ..... 123/399; 123/361

(58) Field of Classification Search ..... 123/337, 123/361, 399; 73/116
See application file for complete search history.

(56) References Cited

U.S. PATENT DOCUMENTS 5,431,141 A * 7/1995 Kanazawa et al. ..... 123/399
5,452,697 A * 9/1995 Sasaki et al. ..... 123/399
6,279,535 B1 * 8/2001 Matsusaka ..... 123/399
6,286,481 B1 * 9/2001 Bos et al. ..... 123/399
6,341,593 B1 * 1/2002 Kamimura et al. ..... 123/337

* cited by examiner

*Primary Examiner*—Tony M. Argenbright
(74) *Attorney, Agent, or Firm*—Ronald E. Greigg

(57) ABSTRACT

The invention relates to a throttle device to be received in the intake system of an internal combustion engine, and includes a mechanism housing for receiving an actuator that actuates a throttle valve. A lid element which can be mounted on the mechanism housing is embodied in modular form and includes an opening for receiving a sensor module, which can be positioned independently of the mounting position of the lid element on the mechanism housing relative to a bearing point.

10 Claims, 3 Drawing Sheets

THROTTLE HOUSING COMPRISING A MODULAR LID ELEMENT

CROSS-REFERENCE TO RELATED APPLICATIONS

This application is a 35 USC 371 application of PCT/DE 02/04330 filed on Nov. 26, 2002.

BACKGROUND OF THE INVENTION

Field of the Invention

In the intake system of internal combustion engines, throttle valves are used with which the flow rate of the aspirated air delivered to the engine is controlled. For detecting the throttle valve position, sensor systems are used. A rotary angle sensor that detects the rotary angle position of the throttle valve is integrated with a plug plate that is built directly into the mechanism housing of the throttle valve unit.

PRIOR ART

German Patent Disclosure DE 195 25 510 A1 discloses a throttle valve adjusting unit adjusting unit including a throttle valve that is received on a throttle valve shaft supported rotatably in a throttle valve support. The throttle valve is movable with a control motor that is associated with the throttle valve shaft and supported on the throttle valve support, and it has at least one wiper as well as one potentiometer track for detecting an adjusted position of the throttle valve shaft with an electrical terminal. In a connection chamber, the control motor and the potentiometer are connected to the electrical terminal; the connection chamber is also surrounded by a lid that closes it off. The at least one potentiometer track is mounted on the lid, and a coupling part that belongs to the electrical connection is formed onto the lid. At least one motor plug contact is provided on the lid and, when the lid is mounted on the throttle valve support, this plug contact is in electrical contact with a counterpart motor plug contact connected to the control motor.

German Patent Disclosure DE 198 43 771 A1 has an electric motor final control element, particularly for use in a throttle device of an internal combustion engine, as its subject. The electric motor final control element includes a housing and an electric motor disposed inside the housing a drive side.

By means of the electric motor, a movable element disposed in the housing, which in particular is a throttle valve, is driven; a separate electronics housing for receiving control or evaluation electronics can be secured to the housing. The drive side of the electric motor final control element is connected to the electronics housing via electrical connecting means, and the electric connecting means are in particular a component of the electronics housing. The throttle valve housing includes a plug or a bush, which is embodied in complementary form to the connector of the electrical connecting means.

German Patent Disclosure DE 43 29 522 A1 discloses a throttle device which can be built into the intake conduit of an internal combustion engine. The throttle device comprises a housing, a throttle valve triggering means, a position sensor, and a throttle valve secured to a throttle valve shaft; the throttle device is disposed between the air filter connector on the clean air side and the intake system of the engine. The air filter connector and/or the intake system are made from a plastic, and the individual elements of the throttle device are constructed in modular form and are joined together via plug, screw or clamping devices. The housing and/or the throttle valve can be of plastic, and the throttle valve shaft is constructed in two pieces, and the module for the position sensor can be disposed on one half of the shaft, while the module for the throttle valve adjusting unit can be disposed on the other half of the shaft. The adjusting unit, adjusting sensor and throttle valve with the throttle valve shaft form a common unit, and the housing can be integrated with the air filter connector neck or the intake system connector.

SUMMARY OF THE INVENTION

Compared with the versions known from the prior art, the version proposed according to the invention is distinguished above all by the fact that various sensor systems can be integrated with the modular lid element. Thus the fact that in the future, various sensor systems that can be used to detect the angular position of the throttle unit in the intake system of an internal combustion engine can be appropriately addressed. The requirement to keep variant lids adapted individually to the sensor system used on hand is thus obviated. The variants among sensor systems used is limited to the sensor module, making it possible to achieve a more-economical version.

With the version proposed according to the invention, the functions of fixing the lid and positioning the sensor relative to the throttle valve shaft can be separated. This simplifies the construction of the sensors used considerably. Especially when contactless systems are used, such as Hall sensors, very exact positioning of the sensor element is required if high accuracy of detection of the angular position of the throttle valve is to be achieved. This exact positioning of a contactless sensor element cannot be achieved upon the relative motion of a lid element, into which a sensor element is integrated, when the lid element is mounted on the mechanism housing, since both the tolerances and the dimensions of the components to be joined are too great. The version proposed, however, permits positioning of a sensor module, to be integrated in the modular lid element, for instance relative to the throttle valve shaft, regardless of the position in which the modular lid element is received on the mechanism housing of a throttle valve unit. This is moreover advantageous in terms of the resultant chain of tolerances between a moving component, the one throttle valve shaft, and the sensor element, so that with the version proposed according to the invention the lid element is now eliminated as a source of error.

The sensor modules, with which the customer-provided plugs can already be integrated, are introduced into the appropriate openings in the modular lid element and aligned relative to such moving parts as the throttle valve shaft of the throttle valve. The sensor modules that contain the customer plugs also have the advantage that no additional connecting points between the plug and the sensor are required, which considerably reduces the likelihood of failure of the throttle unit at the intake system of the engine. Moreover, in a simple way, the sensor module, which can be mounted together with the modular lid element in the vicinity of the receiving region of the actuator, assures contacting of the control motor of the throttle valve unit.

BRIEF DESCRIPTION OF THE DRAWINGS

The invention is described in further detail below in conjunction with the drawing. Shown are.

DESCRIPTION OF THE PREFERRED EMBODIMENTS

Figure 1:
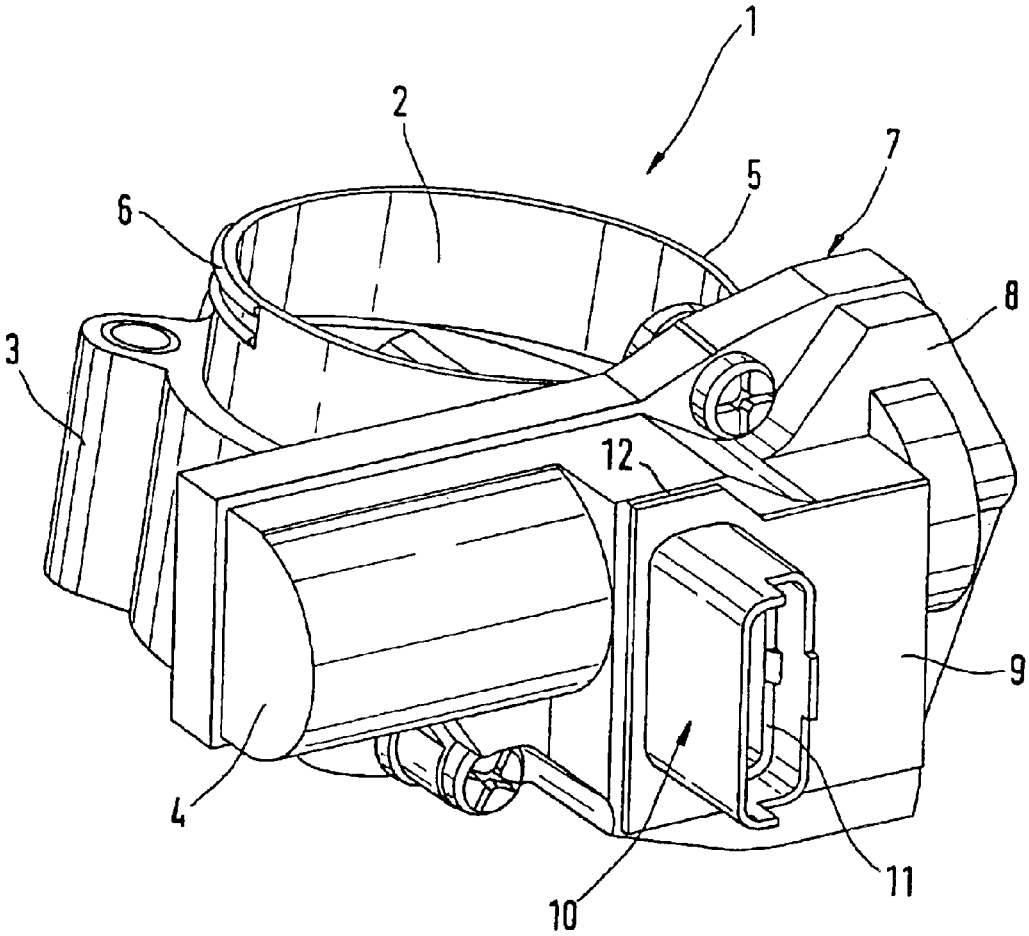
FIG. 1, a mounted throttle valve housing.

FIG. 1 shows a modified throttle valve housing with a sensor module which is integrated with a modular lid element.

A throttle unit for regulating the air flow rate in the intake system of an internal combustion engine includes an intake line flange 1. Received inside the intake line flange 1 is a throttle valve element, which is movable by means of an actuator not shown here and which controls the flow rate of the air passing through the intake cross section 2. On the outside of the intake line flange 1, fasteners 3 are provided. An actuator that actuates the throttle valve received in the intake cross section 2 is disposed in a receptacle 4 between a mechanism housing 7 and a modular lid element 8. The mechanism housing 7 and a modular lid element 8 are screwed together via fasteners, such as the Phillips screws shown in FIG. 1.

One wall 5 of the intake line flange 1 includes a connecting point 6, which can for instance be embodied as a set of ribs or as a thread course embodied partly on the circumferential face of the flange wall 5. At this connecting point 6, the intake line flange 1 of the throttle unit can be connected to the connectors of the intake conduit.

A sensor module 9 is let into the modular lid element 8; its plane face 12 rests on the front side of the modular lid element 8. The sensor module 9 includes a connector 10, which defines a connector opening 11, which in the view in FIG. 1 is embodied in stepped form. On both the inside and outside of the connector 10, individual tabs can be embodied, in order to assure that a plug element, not shown in FIG. 1, will be plugged in right side up.

Figure 2:
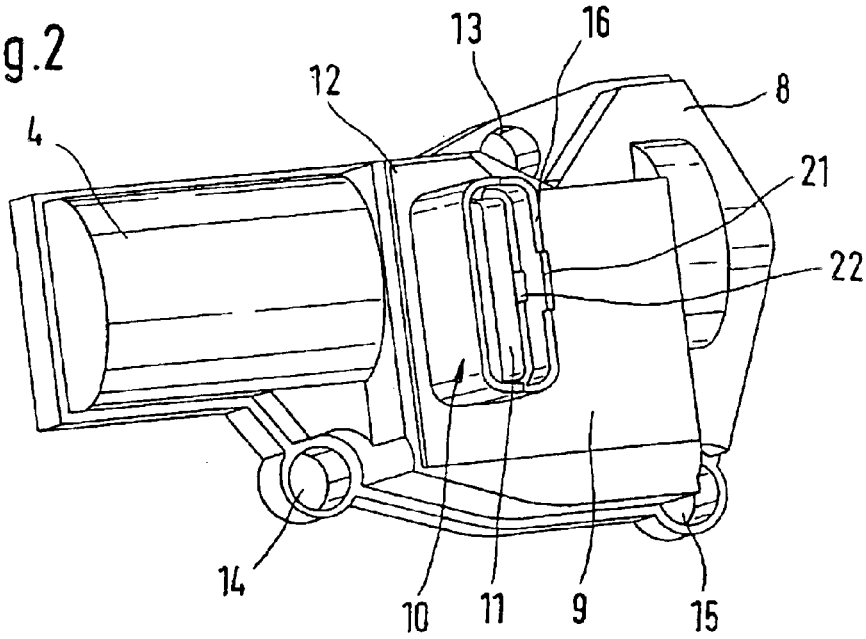
FIG. 2, the modular lid element of the throttle valve housing, with a sensor module received on it, in perspective from the front.

FIG. 2 shows the lid element of the throttle valve unit, with the sensor module received on it, from the front, in perspective.

In the lid element 8, which has an outer rim that surrounds the mechanism housing 7, a plurality of openings 13, 14 and 15 are provided. Into these openings 13, 14 and 15, connecting elements in the form of Phillips screws (see the view in FIG. 1), slotted screws, bolts or other fasteners can be inserted, with which the mechanism housing 7 and the lid element 8 fitting over it can be fixed laterally to the intake line flange 1 of the throttle unit. Instead of the openings 13, 14 and 15, configured here as bores, the fastening of the mechanism housing 7 to the modular lid element 8 fitting over it can also be brought about by way of snap closures or encompassing interlocking means.

Advantageously, both the mechanism housing 7 and the modular lid element 8 fitting over it are manufactured as injection-molded plastic parts. In injection-molded plastic parts, which are mass produced in great numbers, once the injection mold is changed, not only can the openings 13, 14 and 15 of circular cross section be made, but snap closure openings and protrusions can be formed on by injection, with which the components shown in FIGS. 1 and 2, respectively, of a throttle unit can be joined together.

From the view in FIG. 2 in particular, it can be seen that on the sensor module 9, the connector 10 has both a plug tab 22 on the inside and a plug tab 21 on the outside of the plug wall. These plug tabs 21 and 22 embodied on the connector walls prevent a plug element, not shown here, from being inserted wrong into the opening 11 of the connector 10 of the sensor module 9. The plane face 12 of the sensor module 9 is embodied as flat and rests on a plane face, parallel to it, on the top side of the modular lid element 8.

Figure 3:
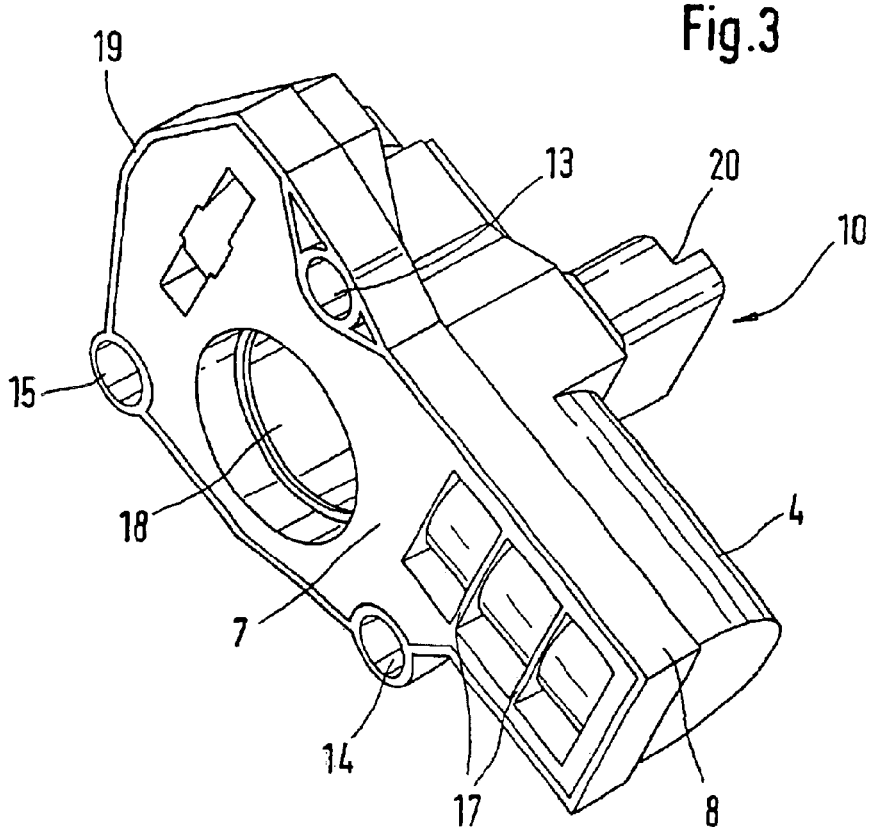
FIG. 3, the lid element and mechanism housing, in perspective from the top.

FIG. 3 shows a lid element and a mechanism housing connected to it, in a perspective plan view.

The region of the modular lid element 8 that includes the actuator necessary for actuating a throttle unit is marked in FIG. 3 by reference numeral 4. In the region of the receptacle 4 on the lid element 8, a set of ribs 17 is formed on by injection in the mechanism housing 7; it serves to reinforce the support of the actuator. The outer rim embodied on the lid element 8 covers an encompassing rim 27, which is not visible in FIG. 3, on the mechanism housing 7. A circular opening 18 is also recessed out of the mechanism housing 7. The circular opening 18 functions as a bearing point for one end, not shown in FIG. 3, of the throttle valve shaft, on which the throttle valve is received. By means of the actuator, surrounded by the receptacle 4 of the lid element 8, the throttle valve shaft is moved, and as a result, the rotary position of the throttle valve in the intake cross section 2 of the intake line flange 1 of the throttle unit varies accordingly, depending on the triggering.

The rotary position of the throttle valve is detected by means of the sensor module 9. The sensor module 9 can include a sensor that has a potentiometer or a contactless sensor, such as a Hall sensor. Reference numeral 13 designates the first opening in the lid element 8 and in the mechanism housing 7, while reference numerals 14 and 15 designate the second and third openings in the mechanism housing 7 and in the modularly constructed lid element 8. Reference numeral 20, as shown in FIG. 3, is a step embodied in the connector 10 of the sensor module 9, which prevents a plug element from being inserted wrong into the opening in the connector 10.

Figure 4:
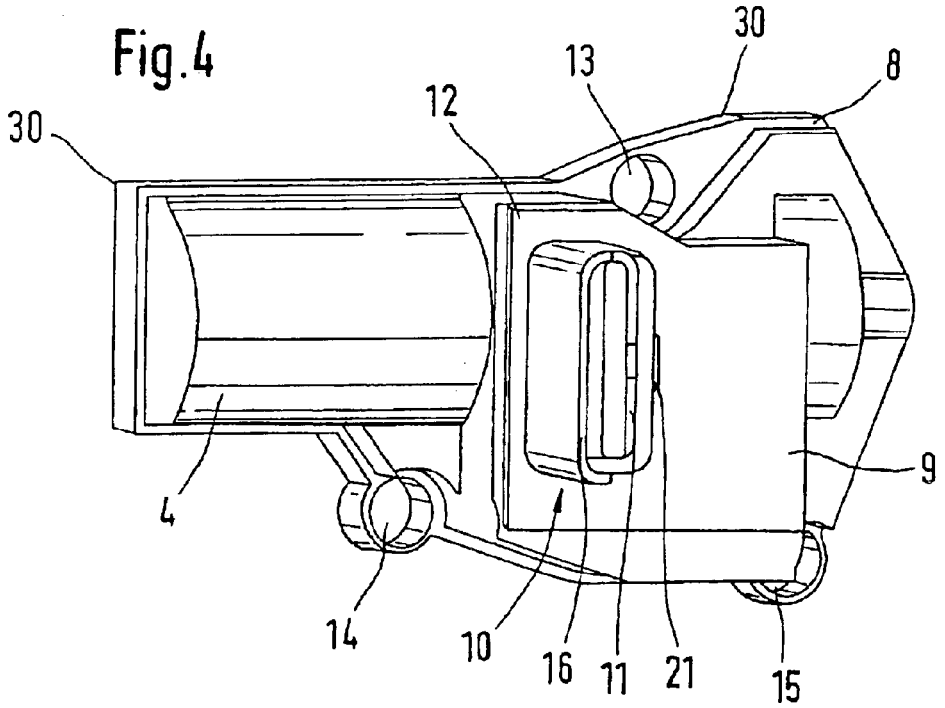
FIG. 4, the front view of the sensor module, secured to the lid element and let into it.

In FIG. 4, the front view of the sensor module secured to the lid element can be seen.

At the lid element 8, the sensor element 9 rests with its plane face 12 on a place face that is parallel to the latter. The lid element 8 includes an outer rim 30, which fits over an encompassing rim 27 embodied on the mechanism housing 7. The outer rim 30 extends along the lid element 8, completely covering the encompassing rim 27 of the mechanism housing 7. The connector 10, which defines the opening 11, is provided on its wall 16 with the aforementioned outer plug tab 21. Reference numerals 13, 14 and 15, respectively, designate the first, second and third openings on the modular lid element 8.

Figure 5:
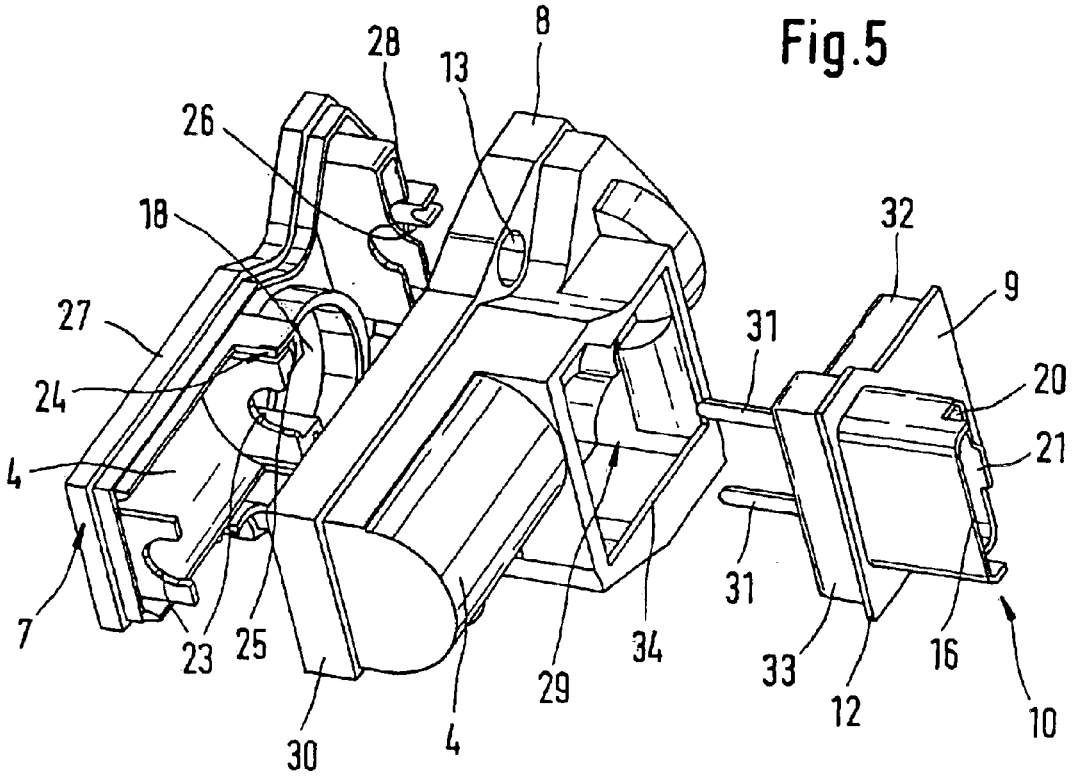
FIG. 5, an exploded view of the mechanism housing, lid element, and sensor module.

FIG. 5 shows an exploded view of the throttle unit, the mechanism housing, the lid element, and the sensor module.

An encompassing rim 27 is disposed on the mechanism housing 7. In the interior of the mechanism housing 9, there are bearing elements 23, configured in the shape of a U, which serve to receive an actuator, not shown but embodied for instance electrically. An opening 18 is also embodied in the mechanism housing 7, and an annularly extending rib is in turn embodied on it. The throttle valve shaft, not shown, on which the throttle valve is in turn embodied is rotatably received in the opening 18. Behind the opening 18, embodied in the bottom of the mechanism housing 7 and serving as a bearing point for the throttle valve shaft, there is an adjusting wheel receptacle 28, as well as a motor shaft bearing 26.

The receptacle 4 for the actuator is formed by injection on the lid element 8, corresponding to the bearing points 23 of the drive. Opposite the adjusting wheel receptacle 28, on the front side of the modular lid element 8, there is a semicircular bulge, which covers the adjusting wheel that is led into the adjusting wheel receptacle 28. A lid opening 29, which is defined by an edge 34, is provided on the front side of the modular lid element 8. The encompassing outer rim 30 on the modular lid element 8 is dimensioned such that it covers the encompassing rim 27 on the bottom of the mechanism housing 7.

The sensor module 9 includes both the aforementioned plane face 12 and a sensor module body 32, whose side faces 33 rest on the edge 34 of the lid opening 29. By means of the course of the edge 34 of the lid opening 29, it is assured that the sensor module 9 will be introduced into the modular lid element 8 in the correct installed position. At least one plug prong 31 is embodied on the sensor module 9. In the variant embodiment of the sensor module 9 shown in FIG. 5, two plug prongs 31 are provided, oriented one above the other, on the sensor module body 32.

When the sensor module 9 is introduced into the lid opening 29 in the axial direction—relative to the location of the bearing point 18 of the throttle valve shaft—the plug prongs 31 on the sensor module body 32 are introduced into plug receptacles 24, which are provided on the bottom of the mechanism housing 7. In the view of the mechanism housing 7 in FIG. 5, the plug receptacles 24 are configured for example as T-slots 25. Thus by means of the sensor module 9, the actuator received in the bearing points 23 and surrounded by the receptacle 4 of the modular lid element 8 can be contacted electrically.

The injection-molded component, embodied as a modular lid element 8 to be joined to the mechanism housing 7, makes it possible to separate the functions of fixing the mechanism housing 7 and sensor module 9 and aligning the sensor module 9 relative to the location of the component whose rotary position is to be detected—in this case, the rotary position of a throttle valve shaft. First, the modular lid element 8 is joined to the mechanism housing 7. This can be done by interlocking of the encompassing rim 27 with the outer rim 30, which is embodied suitably oversized, of the lid element 8. By means of fasteners such as screws or bolts that are inserted through the openings 13, 14, 15 (see the view in FIG. 1), the unit joined together from the mechanism housing 7 and modular lid element 8 can be secured laterally to the intake line flange 1.

Once the components 7 and 8 of the throttle unit have been joined, the sensor module 9 is then introduced into the opening 29 and aligned accordingly with the opening 18 in the bottom of the mechanism housing 7. Thus simple adjustment of the sensor module 9 can be performed independently of the position of the modular lid element 8 on the mechanism housing 7. The alignment is done only for the sensor module 9, which is to be inserted into the top side of the modular lid element 8. Thus the sensor module 9 takes on the task of both electrically contacting the actuator, via the plug prongs 31 to be introduced into the plug receptacles 24, and connecting the sensor elements. An alignment of the sensor module 9 independently of the installed position of the lid element 8 is of decisive importance, especially in contactless sensor systems, if high measurement accuracy is to be attained. The modular lid element 8, preferably in the form of an injection-molded plastic part, can be manufactured in great numbers in a single variant embodiment; the deviation remains limited to the sensor module, making more-economical production of a throttle valve unit possible. In addition to sensor modules that for instance include potentiometers, the sensor module 9 can also be equipped with contactless rotary angle sensors, for instance in the form of Hall sensors. If Hall sensors are used as contactless rotary angle sensors, then very exact positioning of the sensor module 9 is required. This exact sensor position can be achieved, with the version proposed according to the invention, regardless of the installed position of the lid element, since an alignment of the sensor module 9 relative to the modular lid element 8, which is manufactured as a standard mass-produced part, is easily possible.

The sensor modules 9 shown can already be provided with customer plugs, so that in an especially advantageous way, no connecting points between the plug and inserted sensor elements are needed. This in turn leads to a reduction in the likelihood of failure from breakage of connecting points as a consequence of unavoidable jarring in the engine compartment of a motor vehicle.

In the sensor module 9 in FIG. 5, the step 20 on the connector 10 can be seen, which prevents a plug element from being plugged in upside down. The outside tab 21 can be seen clearly in the wall 16 of the connector 10. The sensor module 9 advantageously makes it possible simultaneously to connect the actuator, which is protected from the modular lid element 8, for actuating a throttle valve, and to contact the sensor element electrically, for detecting the rotary position of this part in a throttle unit.

The foregoing relates to preferred exemplary embodiments of the invention, it being understood that other variants and embodiments thereof are possible within the spirit and scope of the invention, the latter being defined by the appended claims.

What is claimed is:

1. In a throttle device to be received in the intake system of an internal combustion engine, having a mechanism housing (7) for receiving both an actuator that actuates a throttle valve and a lid element (8) that can be mounted on the mechanism housing (7), the improvement wherein the lid element (8) is embodied in modular form and includes an opening (29) for receiving a sensor module (9), which module can be positioned independently of the mounting position of the lid element (8) on the mechanism housing (7) relative to a bearing point (18).

2. The throttle device of claim 1, wherein the modular lid element (8) comprises an outer rim (30), which fits over an encompassing rim (27) on the mechanism housing (7).

3. The throttle device of claim 1, wherein the bearing point (18) is disposed in the mechanism housing (7).

4. The throttle device of claim 3, wherein the sensor module (9) can be mounted on the modular lid element (8) in the axial direction relative to the bearing point (18) on the mechanism housing (7).

5. The throttle device of claim 1, wherein the sensor module (9) comprises a module body (32) to be received in the opening (29) of the modular lid element (8), and a plane face (12) for resting on the modular lid element (8).

6. The throttle device of claim 1, wherein the sensor module (9) comprises at least one plug prong (31), which can be introduced into a plug receptacle (24) in the mechanism housing (7).

7. The throttle device of claim 1, wherein the sensor module (9) comprises a customer sensor contact means (10, 11) and the contact means (31) of the actuator of a throttle valve unit.

8. The throttle device of claim 1, wherein the sensor module (9) comprises a potentiometer for detecting the rotary position.

9. The throttle device of claim 1, wherein the sensor module (9) comprises a contactless rotary angle sensor.

10. The throttle device of claim 9, wherein the contactless rotary angle sensor is designed as a Hall sensor.

* * * * *